US008466785B2

(12) United States Patent
Kamalakannan et al.

(10) Patent No.: US 8,466,785 B2
(45) Date of Patent: Jun. 18, 2013

(54) METHOD AND APPARATUS FOR GENERATING LOCALIZED FIRE INCIDENT AND FIRE EXIT ROUTE MAP

(75) Inventors: Arunkumar Kamalakannan, Tamilnadu (IN); Murali R, Karnataka (IN); Deepak Sundar, Karnataka (IN)

(73) Assignee: Honeywell International Inc., Morristown, NJ (US)

( * ) Notice: Subject to any disclaimer, the term of this patent is extended or adjusted under 35 U.S.C. 154(b) by 316 days.

(21) Appl. No.: 12/844,674

(22) Filed: Jul. 27, 2010

(65) Prior Publication Data

US 2012/0025971 A1 Feb. 2, 2012

(51) Int. Cl.
*G08B 25/00* (2006.01)

(52) U.S. Cl.
USPC ..... 340/525; 340/524; 340/540; 340/573.1; 340/539.13

(58) Field of Classification Search
USPC ..... 705/14, 1.1; 455/41.2, 404.2; 342/463; 340/525, 524, 540, 573.1, 539.13, 539.18
See application file for complete search history.

(56) References Cited

U.S. PATENT DOCUMENTS

| | | | | |
|---|---|---|---|---|
| 7,143,050 | B2 * | 11/2006 | Crane | 705/2 |
| 2004/0239498 | A1 * | 12/2004 | Miller | 340/539.13 |
| 2006/0109113 | A1 * | 5/2006 | Reyes et al. | 340/541 |
| 2007/0188318 | A1 * | 8/2007 | Cole et al. | 340/539.13 |
| 2009/0138353 | A1 * | 5/2009 | Mendelson | 705/14 |
| 2010/0280836 | A1 * | 11/2010 | Lu et al. | 705/1.1 |
| 2011/0205068 | A1 * | 8/2011 | Huynh et al. | 340/573.1 |

OTHER PUBLICATIONS

Tyco; TXG Tyco Expert Graphics; www.tycoemea.com/English/Products/Fire/zettlerexpertgraphics.asp; Sep. 10, 2012; pp. 1-2.
Fike; Precise Event Management Software and Computer Graphics; www.fike.com/Products/fagraphics.html; Sep. 10, 2012; p. 1.
Siemens; Revolutionary Power: Direct Current in Buildings; www.simens.com/innovation/en/nwes/2012/e_inno_1222_1.htm; Sep. 10, 2012 pp. 1-2.

* cited by examiner

*Primary Examiner* — Hoi Lau
(74) *Attorney, Agent, or Firm* — Husch Blackwell LLP

(57) ABSTRACT

A method and apparatus are provided for finding fires. The method includes providing a plurality of reference locations within a facility where each of the reference locations is associated with a readily identifiable feature of the facility, detecting a fire within the facility, receiving a fire location request from a monitoring location within the facility and dynamically generating a routing map from the monitoring location to a location of the fire and from the fire to a fire exit of the facility using at least some of the plurality of reference locations based upon the request.

23 Claims, 3 Drawing Sheets

METHOD AND APPARATUS FOR GENERATING LOCALIZED FIRE INCIDENT AND FIRE EXIT ROUTE MAP

FIELD OF THE INVENTION

The field of the invention relates to fire alarm systems and more particularly to methods of locating fires.

BACKGROUND OF THE INVENTION

Fire alarms and fire alarm systems are generally known. Such systems generally include a number of fire detectors distributed around a protected area. The fire detectors may be based upon any of a number of different fire detection technology (e.g., smoke detection, carbon monoxide detection, etc.).

Each of the fire detectors is typically connected to a fire alarm control panel. The connection between each of the sensors and the control panel may be wired or wireless.

The control panel monitors each of the sensors for an indication of the presence of a fire and, in response, sounds an alarm. The control panel may also send notification of the fire to a central monitoring station via a communication connection (e.g., a dial-up connection, the Internet, etc.).

Most fire alarm control panels are typically provided with a display that provides an indication of any sensors that have been activated by a fire. The indications are typically provided with an alpha-numeric identifier or a short description of the location of the fire.

While such systems are effective for personnel familiar with the protected facility, they are not very helpful for outside firefighters. In this case, outside firefighters may require access to a facility map to a cross reference between the identifier of a fire sensor to a location within the protected facility.

However, even with the activated sensor identified on a map, the firefighter may still not be able to quickly access the fire. Doors may be locked. Corridors may be blocked. Accordingly, a need exists for better methods of guiding firefighters to fires.

DETAILED DESCRIPTION OF AN ILLUSTRATED EMBODIMENT

Figure 1:
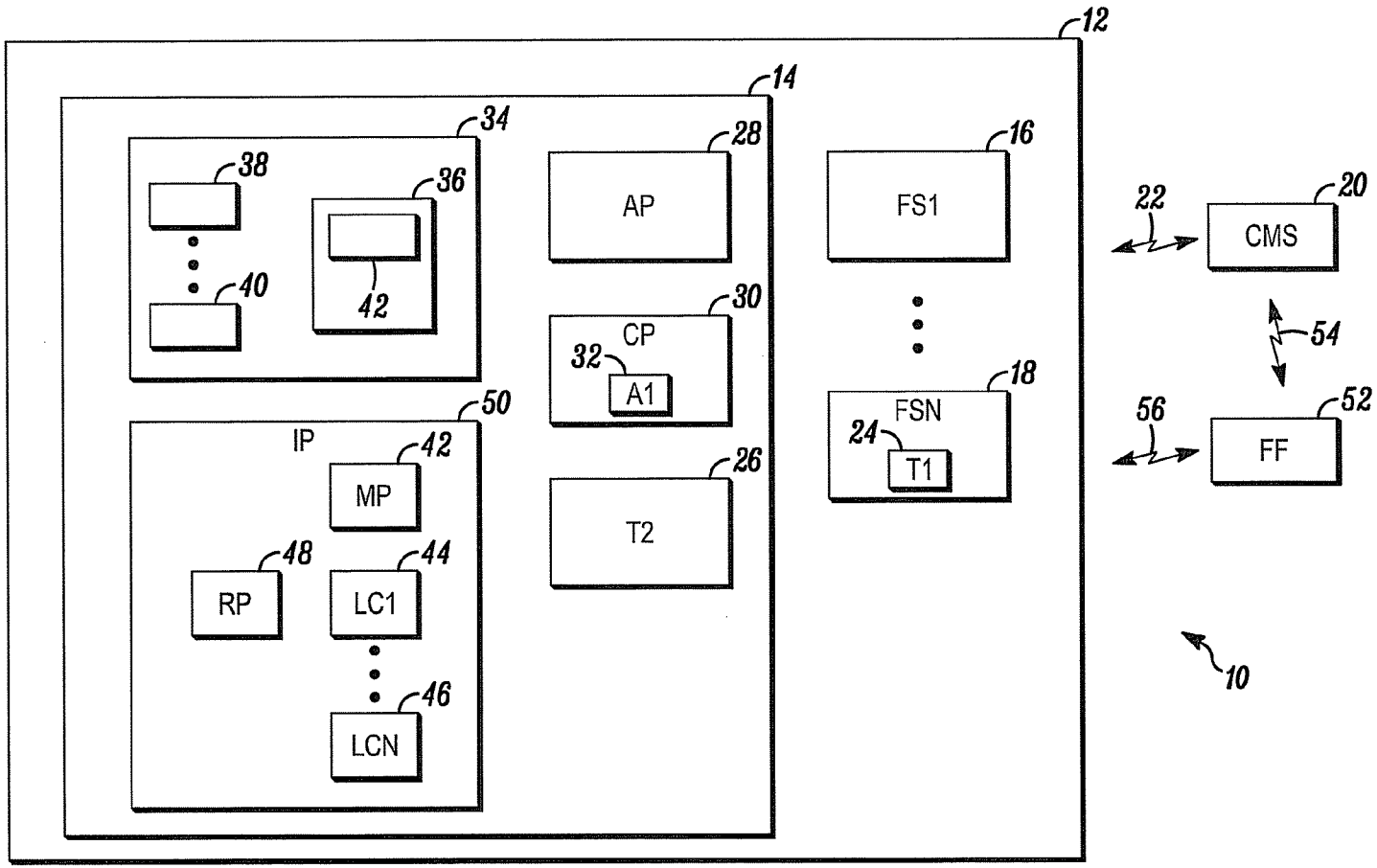
FIG. 1 is a block diagram of a fire reporting system shown generally in accordance with an illustrated embodiment of the invention.

FIG. 1 is a block diagram of a fire detection system 10 for a protected area 12 shown generally in accordance with an illustrated embodiment of the invention. Under illustrated embodiments of the invention, the system 10 operates to automatically provide a route to a fire within a protected premises.

In the event of a fire, fire fighters often reach the premises of a fire and then struggle to identify the exact location of the fire (e.g., in a multi-story building). In order to address this problem, some centralized fire detection systems provide maps to help fire fighters identify a fire location and to act upon such information.

Even though these systems locate a fire on the map layout, they do not provide comprehensive information about a route to reach the location of the fire, especially in the case of a fire fighter entering a facility for a first time. The difficulty is that it is difficult for the fire fighter to identify the entry points of a floor and the most efficient path to reach the location of a fire as well as the fire exit which is nearest to the location of the fire.

The system 10 operates by using a process and apparatus that generates a dynamic route map to the location of the incident and guides the fire fighter to reach the destination in a much quicker manner. The route map generated is provided with respect to the entry points of the facility/floor. The map is optimal and represents the shortest route to reach the location of the fire.

The route provided by the system 10 is based upon the use of one or more virtual reference points (as discussed in more detail below). A reference point is a virtual point or location identified by the Cartesian coordinates of the location.

Included within the system 10 may be a control panel 14 and a number of fire sensors 16, 18. The fire sensors 16, 18, may operate under any appropriate technology (e.g., smoke detection, carbon monoxide detection, heat, etc.).

The sensors 16, 18 may be wired to the control panel 14 or they may communicate wirelessly. If wired, then the control panel 14 and sensors 16, 18 may be connected in parallel to a set of communication conductors (e.g., a communication bus).

If operating under a wireless technology, then a transceiver 24 under control of a communication processor 30 within each of the fire sensors 16, 18 may exchange communicated signals with a transceiver 26 within the control panel 14. Communication in this situation may occur under a TDMA format with the control panel operating within one or more slots of the TDMA channel and with one or more sensors 16, 18 assigned to other slots of the TDMA channel. The control panel 14 and sensors 16, 18 may be synchronized to a common time base through a synchronization signal transmitted by either the control panel 14 or one or more sensors 16, 18.

In either case, the control panel 14 and sensors 16, 18 may periodically exchange messages to confirm proper operation. Alternatively, the control panel 14 may periodically poll each of the sensors 16, 18 for status information. In polling is used, the communication processor 30 within the control panel 14 may periodically compose and send a status request message to each sensor 16, 18 including a system (e.g., IP) address of the sensor 16, 18 along with an instruction requesting status information. The sensor 16, 18 may responds with a status message including a system address of the control panel 14, a system address of the sensor 16, 18 and status data.

If operating under a common time base, the sensors 16, 18 may periodically send status reports in accordance with the time base used. The status reports may be synchronized to a synchronization message transmitted by the control panel 14 or one or more of the sensors 16, 18 or the reports may be transmitted randomly. In each case, messages from the sensors 16, 18 may include a system address of the control panel 14 and a system address of the respective sensor 16, 18 along with status information. The messages from the control panel 14 may be formatted in a similar manner except that instead of status information, the control panel 14 may include one or more control instructions to be executed by the target sensor 16, 18.

In the event that one of the sensors 16, 18 should be activated by a fire, then that sensor 16, 18 may immediately respond by sending an alarm message to the control panel 14. Upon receiving the alarm message, the control panel 14 may activate a local audible and/or visible fire alarm. The control panel 14 may also compose and send an alarm message 22 to a central monitoring station 20.

The central monitoring station 20 may respond by summoning a local fire department. Alternatively, if the system 10 does not rely upon the use of a central monitoring station 20, local personnel within the protected area 12 may summon the fire department in response to notification of the fire through operation of the audible and/or visible alarms.

Upon arrival of the fire department personnel at the location of the secured area 12, the personnel may begin to try to locate the fire. This may be difficult in large installations with multiple floors and/or multiple buildings.

In order to help fire personnel locate a fire, the system 10 may include one or more graphical displays 34. Provided on the graphical displays 34 may be one or maps 36 of the protected area with any activated sensors 16, 18 prominently displayed as a fire symbol 42. Located on the display 34 or adjacent the display 34 may be a number of selector devices (e.g., softkeys) 38, 40 that control the display of information on the display 34.

The graphical displays 34 may be located on the control panel 14 or may be provided in the form of one or more stand-alone terminals. If provided in the form of stand-alone terminals, the terminals may be located where ever fire department personnel are likely to enter the protected area (e.g., main entrance, loading dock, employee entrance, etc.).

Under illustrated embodiments of the invention, the graphical displays 34 may be used to guide firefighters to the location of a fire and from the fire to a nearest fire exit. Guidance, in this case, means a graphical indication of a specific path through the protected area to the fire and from the fire to the nearest fire exit. In this case, the graphical indication is a contrasting indicator (e.g., a dark line) shown on a map of the protected area 104 that identifies the fastest route through the protected area to the fire and from the fire to the nearest exit.

Figure 2:
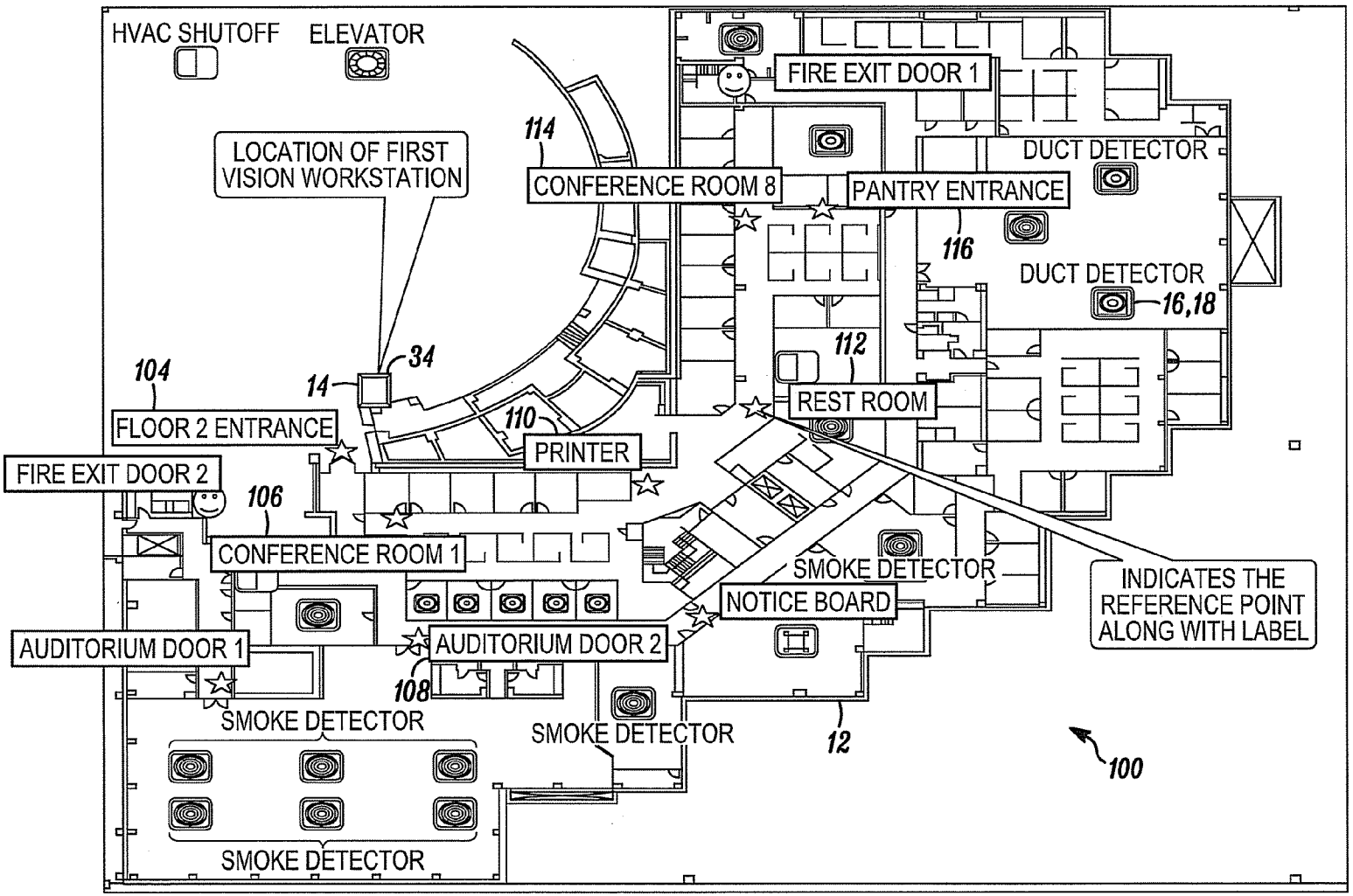
FIG. 2 is a map of a facility protected by the system of FIG. 1 showing a number of virtual reference points.

FIG. 2 is an exemplary map 100 of the protected area 12. Distributed throughout the protected area 12 may be a number of fire detectors 16, 18. The fire detectors 16, 18 are in wireless or wired contact with the panel 14 as described above for FIG. 1.

As a first step in being able to be able to dynamically generate route maps to fires, a user of the system 10 (i.e., a building manager, facility manager, etc.) may designate a set of virtual reference points. A virtual reference point is an easily identifiable physical feature of the secured area 12 that can be used for the benefit of a person unfamiliar with the secured area 12 (e.g., a firefighter) to unambiguously lead the person through the facility 12 to some destination.

The building manager may identify the reference points based upon at least two indicia. The first indicia may be the identifying characteristic of the reference point. The second indicia may be the coordinates (e.g., Cartesian coordinates) of the reference point using some reference point indicator (e.g., a GPS receiver).

For example, the person may enter the facility 12 through a main entrance and proceed to the display 34 located within a lobby area. A first virtual reference point may be an entrance 104. If the lobby area has only a single point of entrance/egress from the lobby to the reminder of the facility 12, then the reference point may simply be a door. Alternatively, if there is more than one point of entrance/egress between the lobby and the remainder of the facility 12, the first reference point 104 may be labeled with a sign (e.g., "Floor 2 Entrance" as shown in FIG. 2). In this example, the indicia of the first reference point may be a set of coordinates a,b and the indication "sign, "Floor 2 Entrance."

Other reference points may or may not be located proximate the first reference point 104. For example, if the person has two possible paths in which to proceed from the first reference point 104, then two other reference points may be provided within view of the first reference point 104 to lead the person along one path over the other.

For example, a person who enters the facility 12 past the first reference point 104 may proceed along a corridor towards an auditorium or turn left along another corridor. In this case, a second reference point 108 may be provided to lead the person to the auditorium. In this case, the second reference point may be a sign (e.g., "Auditorium Door 2").

Alternatively, a third reference point 106 may lead the person to turn left along the corridor. In this case, the third reference point 106 may also be a sign (e.g., "Conference Room 1").

The corridor past the reference point 106 may continue for some distance with only offices on either side. As such, a person may continue along the corridor for some distance without the need for another reference.

At the end of the corridor, another reference point 110 is provided. In this case, the reference point is a printer. In this case, a printer is readily recognizable without an alphanumeric sign.

Other reference points may also be provided along a main corridor through the facility 12. The other reference points may include a rest room (identified by the sign "Rest Rooms") 112, a conference room (identified by the sign "Conference Room 8") 114 or a pantry entrance (identified by the sign "Pantry Entrance") 116.

The process of defining a route from a display 34 to a fire may be based upon a set of logical rules and distance calculations. For example, if a route request is received from a lobby "A", the lobby only has one path "B" to/from the remainder of the protected area 12, the path is identified by reference point "C", then selection of the reference point C may be based upon the rule A+B=C. In this example, the operator "+" indicates a Boolean AND. In other cases, selection of reference points may be based upon identifying nearest reference points that are between a current position and the fire.

In the event of a fire, the alarm processor 28 may transfer an alarm message to a map processor 42. In response, the map processor 42 may generate the map of FIG. 3.

Based upon the alarm message from the alarm processor 28, the map processor 42 may retrieve a location reference (Cartesian coordinates) 44, 46 of the activated sensor 16, 18 based upon an identifier of the sensor 16, 18 contained within the alarm message. Based upon the retrieved location reference 44, 46, the map processor 42 may depict a fire icon 150 showing a location of the fire (e.g., the activated sensor 164) on the map of FIG. 3.

Figure 3:
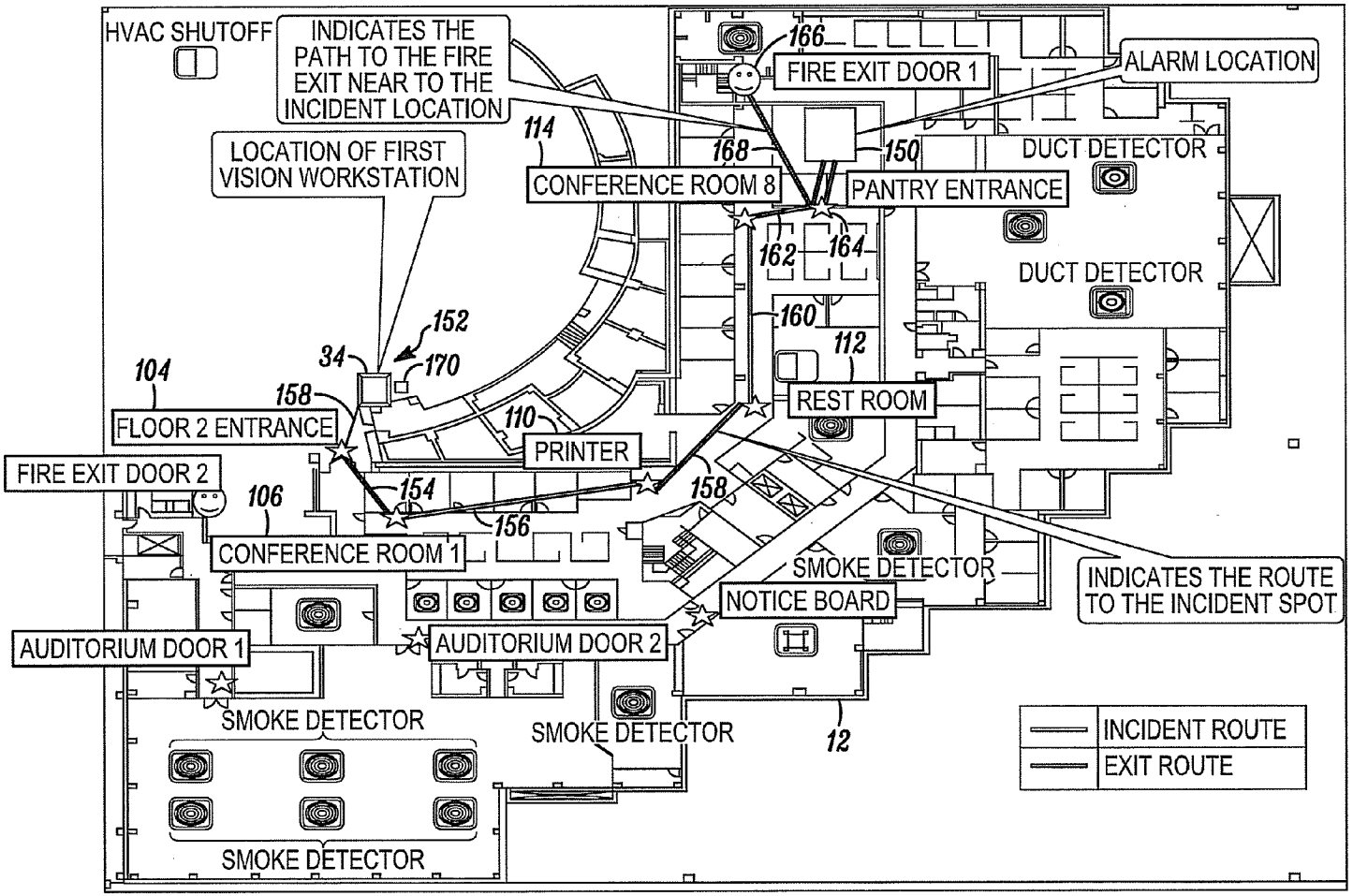
FIG. 3 is a map showing an optimized route to a fire and from the fire to a fire exit that may be generated by the system of FIG. 1.

Upon arrival of fire department personnel at the facility 12, the person may approach the display 34 to view the map of FIG. 3. Located on the display 34 may be a softkey 38, 40 that the person may use to request a route from the display device 34 to the location of the fire.

Included within an image processor 50 may be a routing processor 48 that monitors the softkeys 38, 40. Activation of the route request softkey 38, 40 may cause the routing processor 48 to identify the most direct route from the display 34 (from which the routing request is received) to the fire.

In order to identify a route to the fire, the routing processor 48 may first retrieve a location coordinate 44, 46 of the display 34 and of the activated sensor 16, 18. With the location coordinates 44, 46 of the display 34 and activated sensor 16, 18, the routing processor 48 may then begin processing a route to the fire.

As a first step, the routing processor 48 may first attempt to determine the reference that can be used to form a first portion of a route to the fire. In this case, since the reference 104 is the only exit from the area in which the display 34 is located, the reference 104 would be the first reference selected for the route to the fire. Upon selecting the reference 104, the routing processor 48 may highlight the path between the display 34 and the reference 104. The routing processor 48 may do this by forming a black line 158 on the display of FIG. 3 between the display 34 and reference 104.

Since the reference 104 is an entrance into a corridor, the routing processor 48 may next search for the next closest reference that leads in the direction of the fire. In this case, the routing processor 48 may identify the reference 106 and add the line 156 to the map. Using a similar process, the routing processor 48 may identify reference point 110 and add line 156, reference point 112 and add line 158 and reference point 114 and add line 160.

From reference point 114, the routing processor 48 may determine that there are no further reference points closer to the activated sensor 164. In this case, the routing processor 48 may create a line 162 directly from the last identified reference point 114 to the activated sensor 164.

As a second step to the route creating process, the routing processor 48 may provide a route for the fire fighter from the fire to the nearest fire exit. In this case, the routing processor 48 may determine the location of the nearest fire exit door 166. Upon locating the nearest fire exit 166, the routing processor 48 may next attempt to identify the closes reference point between the fire exit 166 and the fire. The routing processor 48 may do this in order to make sure that the fire exit door 166 is clearly visible from the location of the fire. In the example of FIG. 3, there is no reference point closer to the fire than the fire exit door 166. As a consequence, the routing processor 48 may provide a line 168 directly from the fire to the fire exit 166.

In addition to creating a visual indication on the display 34 of a route from the display 34 to the fire and from the fire to the nearest fire exit, the routing processor 48 may also provide a hard-copy of the routing map from the display 34 to the fire location (as indicated by the activated sensor 164). In this case, a printer 170 may be provided adjacent the display 34. A softkey 38, 40 may by provided with appropriate text informing the firefighter that activation of the softkey 38, 40 will send a copy of the routing map to the printer 170 for purposes of printing the hard-copy of the routing map.

In general, the map provided by the mapping processor 42 may be updated dynamically. For example, each time the alarm processor 28 detects an activated sensor 16, 18 and sends notification to the mapping processor 42, the mapping processor adds a fire icon 150 to the map at the location of the newly activated sensor 16, 18.

Similarly, the routing processor 48 may generate routing maps dynamically. In this case, the display 34 may be touch sensitive or offer some other way of selecting one fire icon 150 over another. This feature allows a fire fighter to select any of a number of different activated sensor 16, 18. This feature allows different fire fighters to concurrently select different fire locations (destinations) and to request and receive routing maps to different fires (i.e., fire sensors 16, 18). In the case where the protected area 12 has a number of different fire system displays 34, fire fighters may simultaneously select routes the same or to different fire destinations from different starting points.

In order to further optimize routes from displays 34 to activated sensors 16, 18, the routing processor 48 may calculate routes along different paths. For each different path, the routing processor 48 may calculate a total distance along each path and select the path with the shortest distance.

Alternatively, the routing processor 48 may select routes based upon other factors. For example, in the case where multiple sensors 16, 18 are activated, the route to a requested location may be selected that avoids hot spots indicated by other activated sensors 16, 18. Similarly, if a fire occurs during a weekend or other periods when the protected area 12 may be unoccupied, the routing processor 48 may select a longer route to avoid doors that would be locked during such periods.

In another illustrated embodiment of the invention, a fire fighter may access and retrieve a route map from a remote location. In this case, a portable display 52 may be provided for use by fire fighting personnel. The portable display 52 may operate wirelessly under any appropriate format. The portable display 52 may send a map request 54 either to the routing processor 48 either through the central station 20 or a map request 56 to the control panel 14 through the transceiver 26. Under this embodiment, fire fighting personnel may request a route map while traveling to the protected area 12.

Upon receiving the request, the routing processor 48 may interpret the request as originating from some predetermined entry point (e.g., the building lobby). Based upon this point of origin, the routing processor 48 may generate a map as discussed above.

A specific embodiment of a system and method for routing fire fighters in unfamiliar locations has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A method comprising:

providing a plurality of reference locations visible from within a facility where each of the reference locations is associated with a readily identifiable feature of the facility;

detecting a fire within the facility;

receiving a fire location request from a monitoring location within the facility; and dynamically generating a routing map showing a route from the monitoring location to a location of the fire and from the fire to a fire exit of the facility using at least some of the plurality of reference locations based upon the request, wherein the routing map shows a description of an identifiable physical feature of each of the plurality of reference locations at a corresponding location along the route from the monitoring location to the location of the fire and from the fire to the fire exit.

2. The method of claim 1 wherein the readily identifiable feature further comprises a room identifier.

3. The method as in claim 2 wherein the room identifier further comprises a wall sign.

4. The method as in claim 1 wherein the monitoring location further comprising a fire alarm control panel.

5. The method as in claim 4 further comprising providing a display on the fire alarm control panel for displaying fire alarms.

6. The method as in claim 1 further monitoring a plurality of fire sensors within the facility.

7. The method as in claim 1 further comprising dynamically generating a plurality of routing maps from the monitoring location to the location of the fire.

8. Apparatus comprising:

at least one reference location visible from within a facility where the at least one reference location is associated with a readily identifiable feature of the facility;

at least one fire detector that detects a fire within the facility;

graphical display within the facility that receives a fire location request from a first responder to the fire; and a processor that dynamically generates a routing map showing a route on the graphical display providing guidance to the first responder from the graphical display to a location of the fire and from the fire to a fire exit of the facility based upon the request and the at least one reference location, wherein the guidance is a contrasting indicator shown on the routing map through the facility to the fire and from the fire to the exit, wherein the routing map shows a description of an identifiable physical feature of the at least one reference location at a corresponding location along the route from the graphical display to the location of the fire and from the fire to the fire exit.

9. The apparatus of claim 8 wherein the readily identifiable feature further comprises a room identifier.

10. The apparatus of in claim 9 wherein the room identifier further comprises a wall sign.

11. The apparatus of in claim 8 wherein the graphical display further comprising a fire alarm control panel.

12. The apparatus of in claim 11 wherein the graphical display further comprising a display on the fire alarm control panel for displaying fire alarms.

13. The apparatus of in claim 8 further means for monitoring a plurality of fire sensors within the facility.

14. The apparatus of in claim 8 further comprising means for dynamically generating a plurality of routing maps from the monitoring location to the location of the fire.

15. Apparatus comprising:

a plurality of reference locations visible from provided within a facility where each of the reference locations is associated with a readily identifiable feature of the facility;

a plurality of fire sensors that detect a fire within the facility;

a display that receives a fire location request from a monitoring location within the facility; and a processor that dynamically generates a routing map showing a route from the monitoring location to a location of the fire and from the fire to a fire exit of the facility using at least some of the plurality of reference locations based upon the request, wherein the routing map shows a description of an identifiable physical feature of each of the plurality of reference locations at a corresponding location along the route from the monitoring location to the location of the fire and from the fire to the fire exit.

16. The apparatus of claim 15 wherein the readily identifiable feature further comprises a room identifier.

17. The apparatus of in claim 16 wherein the room identifier further comprises a wall sign.

18. The apparatus of in claim 16 wherein the monitoring location further comprising a fire alarm control panel.

19. The apparatus of in claim 18 further comprising means for providing a display on the fire alarm control panel for displaying fire alarms.

20. The apparatus of in claim 16 further comprising a routing processor that dynamically generates a plurality of routing maps from the monitoring location to the location of the fire.

21. The method as in claim 1 further comprising receiving the fire location request from a portable display of a fire fighter at remote location outside the facility.

22. The method as in claim 21 further comprising transferring the routing map to the portable device through a central station or a control panel within the facility.

23. The method as in claim 22 further comprising wirelessly sending the routing map to the fire fighter.

* * * * *